United States Patent [19]

Marshall et al.

[11] Patent Number: 4,931,640

[45] Date of Patent: Jun. 5, 1990

[54] MASS SPECTROMETER WITH REDUCED STATIC ELECTRIC FIELD

[76] Inventors: Alan G. Marshall, 3063 Glenrich Parkway, Columbus, Ohio 43221; Mingda Wang, 692 Cuyahoga Ct., Columbus, Ohio 43210

[21] Appl. No.: 355,763

[22] Filed: May 19, 1989

[51] Int. Cl.[5] ..... H01J 49/38

[52] U.S. Cl. ..... 250/291; 250/292; 250/281; 250/282; 250/294

[58] Field of Search ..... 250/291, 292, 281, 282

[56] References Cited

U.S. PATENT DOCUMENTS

| | | | |
|---|---|---|---|
| 2,939,952 | 6/1960 | Paul et al. | 250/291 |
| 3,461,381 | 8/1969 | Nelson et al. | 250/291 |
| 3,475,605 | 10/1969 | Llewellyn | 250/291 |
| 3,511,986 | 5/1970 | Llewellyn | 250/291 |
| 3,527,939 | 9/1970 | Dawson et al. | 250/291 |
| 3,742,212 | 6/1973 | McIver, Jr. | 250/291 |
| 3,937,955 | 2/1976 | Comisarow et al. | 250/291 |
| 3,984,681 | 10/1976 | Fletcher et al. | 250/291 |
| 4,034,191 | 7/1977 | Tomlinson et al. | 235/151.3 |
| 4,090,075 | 5/1978 | Brinkmann | 250/282 |
| 4,315,149 | 2/1982 | Ledford, Jr. | 250/291 |
| 4,535,235 | 8/1985 | McIver, Jr. | 250/291 |
| 4,540,884 | 9/1985 | Stafford et al. | 250/282 |
| 4,581,533 | 4/1986 | Littlejohn et al. | 250/291 |
| 4,588,888 | 5/1985 | Ghaderi et al. | 250/291 |
| 4,686,365 | 6/1987 | Meek et al. | 250/291 |
| 4,739,165 | 4/1988 | Ghaderi et al. | 250/291 |
| 4,761,545 | 8/1988 | Marshall et al. | 250/291 |
| 4,818,864 | 4/1989 | Allemann | 250/291 |

OTHER PUBLICATIONS

Patent Cooperation Treaty Published International Application Number WO 86/04261, published 31 Jul. 1986, entitled "Mass Spectrometer Ion Excitation System".

U.K. Patent Application GB 2,106,311, published Apr. 7, 1983, title: "Method for Ion Cyclotron Resonance Spectroscopy".

Barrett L. Tomlinson and H. D. W. Hill, "Fourier Synthesized Excitation of Nuclear Magnetic Resonance with Application to Homonuclear Decoupling and Solvent Line Suppression," Journal of Chemical Physics, vol. 59, No. 4, 15 Aug. 1973.

Alan G. Marshall and D. Christopher Roe, "Theory of Fourier Transform Ion Cyclotron resonace Mass Spectroscopy: Resonse to Frequency-Sweep Excitation," Journal of Chemical Physics, vol. 73, No. 4, 15 Aug. 1980, pp. 1581-1590.

Alan G. Marshall, Tao-Chin Lin Wang, and Tom Labatuan Ricca, "Ion Cyclotron Resonance Excitation/De-Excitation: A Basis for Stochasti Fourier Transform Ion Cyclotron Mass Spectrometry," Chemical Physics Letters, vol. 105, No. 2, 9 Mar. 1984, pp. 233-235.

Alan G. Mrshall, Tao-Chin L. Wang and Tom L. Ricca, "Fourier Transform Ion Cyclotron Resonance Mass Spectrometry: New Theoretica and Instrumental Developments," ASMS Meeting, San Antonio, Texas, May 27-Jun. 1, 1984, pp. 600-601.

Paper Published by Finnigan MAT, entitled "New Advances in the Operation of the Ion Trap Mass Spectrometer," presented at the 33rd Annual Conference on Mass Spectrometry and Allied Topics, San Diego, California, May 1985.

United States Patent Application serial number 695,847 for "Mass Spectrometer Ion Excitation System", filed Jan. 28, 1985, Group Art Unit: 256, Examiner: B. Anderson.

*Primary Examiner*—Janice A. Howell
*Assistant Examiner*—Kiet T. Nguyen
*Attorney, Agent, or Firm*—Lathrop & Clark

[57] ABSTRACT

An ion cyclotron resonance cell (20) in which samples are analyzed has plates (21, 22) serving as excitation electrodes, top and bottom plates (25, 26) serving as detector electrodes and end trapping plates (23, 24). The cell (20) is maintained in a magnetic field of flux density B oriented longitudinally between the end trapping plates (23, 24). An ion generating source (30) causes ionization of the sample molecules within the cell (20). An electrostatic trapping potential is applied to the end trapping plates (23, 24) to prevent ions from escaping in the direction of the magnetic field B. Grounded screens (40, 41) are positioned within the cell (20) just inside the end trapping plates (23, 24) to reduce an electrostatic electric field in the cell (20) resulting from the application of a potential to the end trapping plates (23, 24).

37 Claims, 7 Drawing Sheets

MASS SPECTROMETER WITH REDUCED STATIC ELECTRIC FIELD

FIELD OF THE INVENTION

This invention pertains generally to the field of mass spectrometry and particularly to static electromagnetic ion cells therefor.

BACKGROUND OF THE INVENTION

An ion cyclotron uses a fixed magnetic field to deflect an ion moving at some velocity through the field. For a spatially uniform magnetic field having a flux density $B_0$, a moving ion of mass m and charge q will be bent into a circular path in an x-y plane perpendicular to the direction of the magnetic field at an angular frequency $\omega_c$ in accordance with: $\omega_c = qB_0/m$. Thus, if the magnetic field strength is known, by measuring the ion cyclotron frequency it is possible in principle to determine the ionic charge-to-mass ratio q/m. In effect, the static magnetic field converts ionic mass into a frequency analog. Because the cyclotron frequencies for singly charged ions ($12 \leqq m/q \leqq 5000$) in a magnetic field of about 3 Tesla span a radio frequency range (10 kHz$\leqq f \leqq$4 MHz), within which frequency can be measured with high precision, the ion cyclotron is potentially capable of offering extremely high mass resolution.

In an ion cyclotron cell, the ions may be formed by irradiation of a neutral gas or solid by various known techniques, including the application of electron, ion, or laser beams directed along the magnetic field. The ions are trapped in the cell because the static magnetic field constrains the ions from escaping anywhere in the x-y plane perpendicular to the field and a small static trapping voltage is applied to the end plates of the cell to prevent the ions from escaping in a z-axis direction parallel to the field. A static electric field is thereby established between the end plates. The application of Gauss's law requires that there be an electric field directed radially outward to balance the "trapping" static electric z field, in order that no net charge be contained in the cell in the absence of ions. The radial electric field opposes the inward-directed Lorentz force $$F = qv \times B,$$

where q is the ionic charge, v is the ion velocity, and B is the magnetic field. The radial electric field thus has the same effect as a decrease in magnetic field strength, thereby decreasing $\omega_c$, the ICR frequency. Further, if the radial electric field varies non-linearly with radial distance from the center of the cell, then the ICR frequency will vary with the pre-excitation position of the ion in the cell, thereby rendering tune-up more difficult and limiting the ultimate mass resolution available during the excitation event. Even for a perfectly quadrupolar electric field in which the field varies linearly with x-, y-, or z-distance from the center of the cell, the radial electric field acts to limit the highest m/q ion that can be held in the cell.

Fourier transform ICR cells were initially cubic in geometry. Other cell geometries, including orthorhombic, cylindrical, hyperbolic, cells that use multi-annulus trapping plates, and multiple-section cells have been used in attempts to minimize some of the undesirable effects of the trapping potential. Although cubic or orthorhombic cells have the advantage of conceptual simplicity and ease of construction, their electrostatic field description is mathematically complicated. The electric field in such a cell has $D_{4h}$ symmetry (symmetry upon 90° rotation) and is represented by an infinite series of Laplace's equation. Where the origin of the Cartesian coordinate system is chosen to lie at the center of the cell, expansion of the series in the spatial region near the center of the cell yields an approximately quadrupolar electric potential $$V(x,y,z) = \frac{V_T}{2} + V_T\left(-\alpha\left(\frac{x}{a}\right)^2 - \alpha\left(\frac{y}{a}\right)^2 + 2\alpha\left(\frac{z}{a}\right)^2 - \gamma\right)$$

where a is the distance between the two end plates, $V_T$ is the trapping voltage applied to the trap voltages, and $\alpha$ and $\gamma$ are functions of the cell dimensions.

The equation of motion of an ion of mass m and charge q in a static electromagnetic ion cell is given by $$m\frac{dv}{dt} = q(E + v \times B)$$

in which the magnetic field direction is assigned to the z-axis, as depicted in FIG. 1, which shows a typical prior art cell.

In the quadrupolar approximation of static electric field, ion motion in the z-direction is separable from motion in the x-y plane in the above equation. There are two eigenfrequencies for x-y motion, the cyclotron and magnetron frequencies, $\omega_o$ and $\omega_m$, $$\omega_o = \frac{1}{2}\left(\omega_c + \sqrt{\omega_c^2 - \frac{8q\alpha V_T}{ma^2}}\right)$$

$$\omega_m = \frac{1}{2}\left(\omega_c - \sqrt{\omega_c^2 - \frac{8q\alpha V_T}{ma^2}}\right)$$

The second of the two equations listed immediately above shows that the observed ICR frequency, $\omega_o$, varies with the trapping potential, $V_T$. In order to reduce the ICR frequency shift induced by the trapping potential, a rectangular cell elongated along the z-axis was introduced. However, for the elongated cell, the quadrupolar approximation breaks down except near the center of the cell, so that the ICR frequency still varies with pre-excitation position of the ion within the cell.

A cylindrical cell has cylindrical symmetry $D_{\infty h}$ (symmetry upon infinite rotation) about the z-axis and has the same symmetry as a quadrupolar potential in the radial direction. However, the use of flat trapping end plates leads to a spatially inhomogeneous electrostatic field. The quadrupolar electric potential is again approached only near the center of the cylindrical cell. Therefore, ion cyclotron frequency again varies with ion pre-excitation position in the cell.

The ion cell geometry that most closely approximates the quadrupolar electrostatic potential is the hyperbolic cell. Two trap electrodes are separated by a ring electrode which is cut lengthwise into quadrants. Each of the three electrode surfaces has the shape of a hyperboloid of revolution. The hyperbolic cell produces a near-perfect quadrupolar electric potential within the cell $$U(x,y,z) = V_T \frac{r_0^2 - x^2 - y^2 + 2z^2}{r_0^2 + 2z_0^2}$$

in which $2r_0$ and $2z_0$ are the radial and z-dimensions of the cell. The ICR frequency for such a cell is given by $$\omega_0 = \frac{1}{2}\left(\omega_c + \sqrt{\omega_c^2 - \frac{8qV_T}{m(r_0^2 + 2z_0^2)}}\right)$$

Although ICR frequency is invariant with ion position in a perfect quadrupolar potential, the above equation shows that the ICR frequency still varies with trapping voltage. However, because the actual hyperbolic electrodes are not infinite, an actual hyperbolic cell does not generate a purely quadrupolar electrostatic potential, and the observed ICR frequency still varies somewhat with ICR orbital radius.

"Compensated" trap electrodes have been proposed in attempts to minimize the ICR frequency shift and sidebands resulting mainly from non-zero x-y components of the inhomogeneous electrostatic field divided into annular segments held at different potential. In one design, the segments are coplanar, whereas in a second design the segments are separated along the z-axis for ease of construction. For either cell, the radial component of the electric field is reduced without loss in ion trapping efficiency. In addition, it has been shown that magnetron frequency shift is also reduced by a factor of about 5.

In yet another approach, an elongated three-section cell with a 6:1 aspect ratio has been proposed. If +1 V is applied to each of the two end plates, the electric potential drops to less than 10 μV in the center of such a cell. Thus, radial electric field-induced ICR frequency shifts can be reduced accordingly if ICR detection is limited to the central electric field-free region of the three-section cell. Mass resolution is also improved by a factor of about 2. However, ions nevertheless oscillate back and forth along the z-axis and in fact spend most of their time in the two end sections, in which the electric field again has major radial components, leading to radial loss of high-mass ions. Furthermore, as in the other above-mentioned cell designs, if ions are distributed nonuniformly in the cell before excitation, then ions of different z-amplitude will dephase with respect to each other, leading to inhomogeneous line-broadening.

SUMMARY OF THE INVENTION

In accordance with the present invention, a mass spectrometer having an ion cyclotron cell with a reduced static electric field is disclosed. The static electric field of the cell is reduced by incorporating grounded or selected fixed-potential screens placed just inside the trapping end plates of the cell. The electric potential of the cell using such screens is near-zero throughout the cell, except in the immediate vicinity of the screens.

Use of the "screened" ion cell of the present invention results in a reduction of ICR frequency shift induced by the trapping potential. Since the main source of deviation of ICR frequency from the cyclotron frequency (which is given by the equation $\omega_c = qB_0/m$) results from ICR shift induced by the trapping potential, the "screened" cell improves the accuracy of mass measurement in Fourier transform ICR mass spectrometry because the mass calibration equation will require smaller correction terms. The new screened cell therefore offers higher mass resolution during detection due to a more uniform electric field.

Where the radial electric field acts to increase the ICR orbital radius during excitation and to reduce maximal mass resolution, reduction of the electric field by the present invention necessarily reduces the radial component of the field. Thus, reduction of the static electric field also results in higher mass resolution during excitation since ICR frequency no longer varies significantly with ICR orbital radius. An attendant advantage is that mass accuracy under the present invention becomes more reproducible since a variation of ion orbital radius from one experiment to another arising from, for example, a variation in ICR excitation conditions, should have much less effect on measured ICR frequencies. Because of the increased reproducibility, tune-up of the mass spectrometer is also expedited.

Since the trapping voltage is generally inversely related to the upper mass limit, the reduction of the radial electric field also the potential for a much higher upper mass limit. Thus, analysis of large (especially biological) molecules is attainable.

Further objects, features, and advantages of the invention will be apparent from the following detailed description when taken in conjunction with the accompanying drawings.

BRIEF DESCRIPTIONS OF THE DRAWINGS

DESCRIPTION OF THE PREFERRED EMBODIMENT

Figure 1:
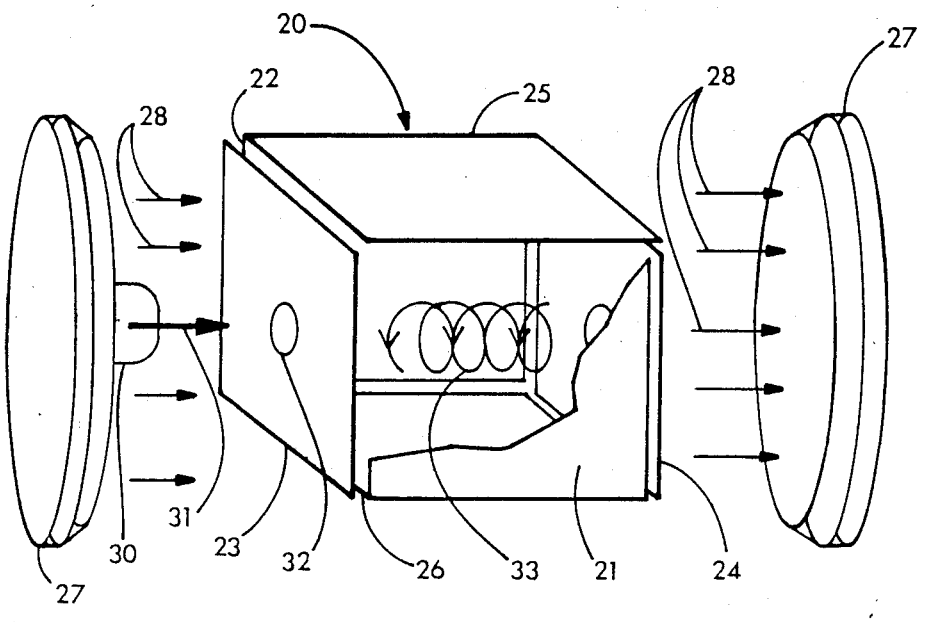
FIG. 1 ( PRIOR ART )
FIG. 1 is a simplified view of an exemplary prior art ion cyclotron resonance (ICR) cell.

With reference to the drawings, a schematic perspective view of an exemplary prior art ion cyclotron resonance cell is shown generally at 20 in FIG. 1. As is well-known in the art, the ion cyclotron resonance (ICR) cell 20 would be enclosed in an evacuable chamber (not shown) and a vacuum pump (also not shown) and other ancillary equipment standard for ICR cells would be utilized to achieve the desired low pressure in the cell. After the cell has been pumped down to the desired pressure, a gas (or solid) sample to be analyzed may be introduced into the cell or adjacent to it from a suitable source in a manner well-known in the art. For purposes of illustration, the ICR cell 20 is shown as having a substantially rectangular cross-section, a parallelepiped form, with opposed side plates 21 and 22 serving as excitation electrodes, end trapping plates 23 and 24, and top and bottom plates 25 and 26, respectively, which may serve as detector electrodes. Various other geometric configurations for ICR cells, such as cylindrical or hyperbolic forms, multiple sets of plates, etc., are known and may also be utilized. The various plates that comprise the ICR cell 20 need not be restricted to the planar shape shown in FIG. 1. The ICR cell 20 is maintained in a substantially constant and preferably uniform magnetic field of flux density B produced by an electrical (or permanent) magnet 27 of any suitable construction, with the field direction being oriented longitudinally, generally between the end plates 23 and 24, as represented by the lines of flux labeled 28. It is understood that other magnetic configurations may also be used, including a solenoid magnet which surrounds the ICR cell.

Various means of producing ions in the cell 20 are well-known and may be used. For purposes of illustration, an ion generating source 30, such as an electron gun, a laser, or other source of ionizing energy, may provide a beam 31 which passes through an opening 32 in the front end plate 23 and causes ionization of gas (or solid) molecules within the cell 20, although the ions may also be formed outside the cell and then transferred inside using techniques well known in the art. These ions are constrained to move in a cycloidal path 33 within the ICR cell 20 by interaction with the constant magnetic field and are trapped within the cell by bias voltages applied to the plates of the cell. The additional well-known magnetron ion motion is not shown in FIGS. 1, 2, or 3. The construction details and operation of ICR cells are well-described elsewhere in various technical papers and patents, for example, in the patent to Comisarow and Marshall, U.S. Pat. No. 3,937,955, the disclosure of which is incorporated herein by reference.

Although the static magnetic field B applied along the z-direction as represented by the lines of flux 28 constrains ion motion in the x-y plane, ions are free to move in the direction of the magnetic field B (z-axis). Therefore, an additional electrostatic trapping potential, produced by applying a static voltage to the end trapping plates 23 and 24, is needed to provide a restoring force to prevent ions from escaping along the z-direction. A static electric field is thus established between the end trapping plates 23 and 24.

Figure 2:
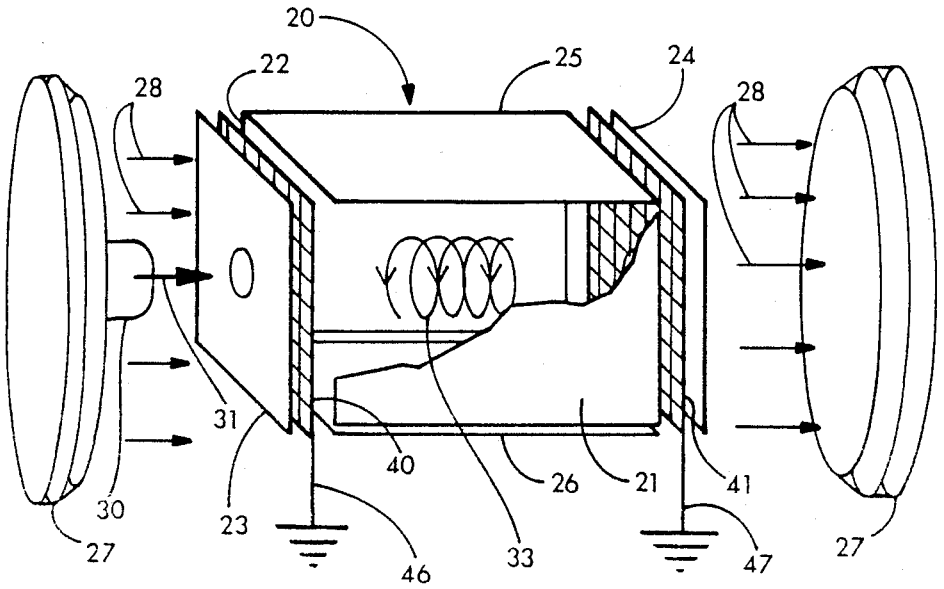
FIG. 2 is a simplified view of the mass spectrometer ICR cell with reduced static electrical field of the present invention.
Figure 3:
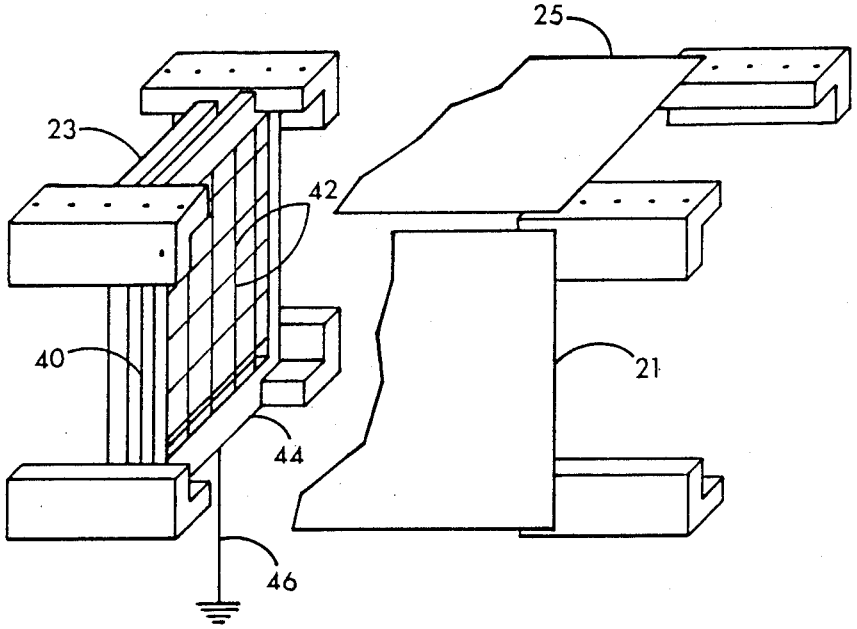
FIG. 3 is a partial detail view of the mass spectrometer ICR cell with reduced static electrical field of the present invention.

FIGS. 2 and 3 show the ICR cell for a mass spectrometer with reduced static electric field of the present invention. The present invention differs from the prior art as depicted in FIG. 1 by the incorporation of screens 40 and 41 positioned inside the cell 20 proximate the end trapping plates 23 and 24, respectively. The screens 40 and 41 act as a shield to reduce the static electric field throughout the cell 20 except in the immediate vicinity of the screens 40 and 41.

Figure 4:
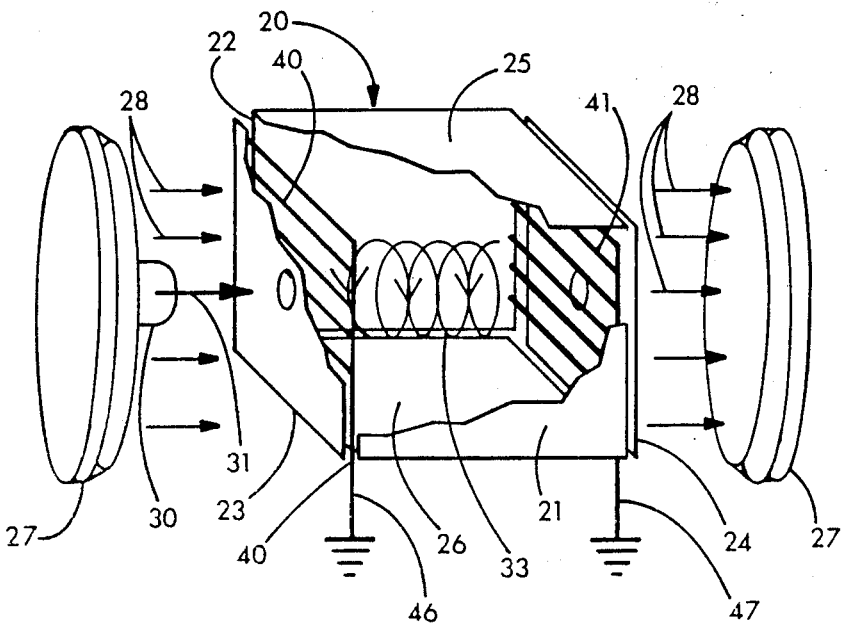
FIG. 4 is a simplified view of an alternate screen geometry in the ICR cell with reduced static electrical field of the present invention.

As best shown in FIG. 3, the screens 40 and 41 are preferably formed of a wire mesh 42 held within a frame 44, having interwoven wire strands and a plurality of evenly spaced interstitial openings formed between the strands in a two-dimensional lattice. The screens 40 and 41 may also be formed in alternative geometries and in different manners. For example, instead of interwoven wire strands, the strands may be run in a planar array of parallel rows across the frame 44, as depicted in FIG. 4. Further, the screens may comprise two such parallel arrays, one horizontal and one vertical, in adjacent relation to form the equivalent of a two-dimensional lattice. Another embodiment would be to form the interstitial openings by perforation of a thin plate by a regular array of holes. Other screen configurations are possible and it is to be understood that the invention is not restricted to a screen having interwoven wire strands. The screens 40 and 41 should have interstitial openings of a size that renders the screens 40 and 41 substantially "transparent" to ion particles, so as to allow passage of ions through the interstitial openings during both mass analysis and ejection, and be restricted to a size that substantially shields the interior of the cell 20 from the static electric field. It may also be desirable for the screens 40 and 41 to have an additional centrally located hole (not shown) for external electron or ion injection. The static electric field is constained to within approximately one mesh width of the screens 40 and 41 in FIG. 2, or the spacing between the wires of the screen 40 and 41 of FIG. 3. The screens 40 and 41 each have an electrical connection 46 and 47, respectively, through which the screens 40 and 41 may be attached to apply a desired voltage. Typically the connections 46 and 47 are attached to a chassis or driver ground, although they may also be gated to apply an arbitrary static voltage during a given stage of an experimental event equence. For example, the connections 46 and 47 may be gated to apply a "quench" voltage for ion z-ejection, or to bias voltage comparable to that on the side plates 21 and 22, and the bottom plates 25 and 26. If the plates 21, 22, 25, and 26 were biased to +40 V, then one would preferably also set the screens 40 and 41 to approximately +40 V to reduce the static electric field in the cell 20 to near zero. The screens 40 and 41, and the frame 44, are preferably composed of a non-magnetic or slightly magnetic material, such as tungsten or stainless steel.

EXAMPLE

Screens as described above were incorporated in an orthorhombic ion cell of dimensions 2.5" (6.35 cm)×2.0" (5.08 cm)×2.0" (5.08 cm). The 2.5" dimension represents the distance of screen-to-screen separation in the cell. The cell was constructed from flat solid oxygen-free hard copper electrodes separated by Macor® spacers. Each screen was constructed from 0.0015" (0.00381 cm) diameter tungsten 50×50 mesh, commercially available from Unique Wire Weaving Co., Inc., 762 Ramsey Avenue, Hillside N.J. 07205. Two out of every three wires were then removed to give a final mesh spacing of 16 per inch. Each trapping plate was placed ¼" (0.635 cm) outside its respective screen. The mesh was held in place by spot-welds to a 314 stainless steel frame.

FT/ICR mass spectra were produced with a Nicolet FTMS-1000 instrument operating at a magnetic field strength of 3.058 tesla (1" cubic, 2"×2"×2.5" orthorhombic screened, and 2"×2"×2.5" orthorhombic unscreened cells) and a Nicolet FTMS-2000 instrument at 3.003 tesla (2" cubic cell). Benzene ($C_6H_6$) was introduced through a Varian No. 951-5100 leak valve to a pressure of $1.2–1.5\times10^{-8}$ torr. $C_6H_6^+$ ions were produced by impact of an electron beam (50 V for 20–40 milliseconds at an emission current of 60–100 nA measured at a collector located outside one of the trapping end plates).

In Table I, Fourier transform ICR mass calibration over approximately one decade in mass for perfluorotri-n-butylamine ($9\times10^{-9}$ torr), produced by a Nicolet FTMS-1000 instrument operated at 3.058 tesla with a screened orthorhombic (2.5"×2.0" square cross-section) ion cell. For the mass calibration in Table I, below, spectral peak frequencies were determined by parabolic three-point approximation and fitted to a mass calibration equation of the form, $m=(A/\nu)+(B/\nu^2)$, with $\nu^2$ and relative peak height weighting. The calculated mass for each singly charged positive ion was computed by subtracting the mass of an electron from the combined mass of the most abundant isotopes. Ions were produced by electron ionization (50 ms at 50 eV at a detected emission current of 50 nA). The spectrum was excited by frequency sweep from dc to 715 kHz (corresponding to m/z=68.79) in 3.58 ms at a radio frequency amplitude of 30 V (peak to peak), and acquired in heterodyne-mode with a reference frequency of 705.96 kHz for 53.47 ms to give 64K time-domain data points, to which another 64K zeroes were added before discrete Fourier transform. No apodization (windowing) was applied.

TABLE I

Fourier Transform ICR Mass Calibration over Approximately 1 Decade in Mass for Perfluorotri-n-butylamine ($9\times10^{-9}$ Torr)

| Ion | ICR Frequency | True Mass | Measured Mass | Error |
|---|---|---|---|---|
| $CF_3^+$ | 680,642.69 Hz | 68.99466 u | 68.99467 u | +0.1 pp |
| $C_2F_5^+$ | 394.651.03 | 118.99147 | 118.99146 | −0.1 |
| $C_3F_5^+$ | 358,496.37 | 130.99147 | 130.99144 | −0.2 |
| $C_4F_9^+$ | 214,438.89 | 218.98508 | 218.98490 | −0.8 |
| $C_5F_{10}N^+$ | 177,881.48 | 263.98656 | 263.98660 | +0.2 |
| $C_8F_{16}^+$ | 113,427.71 | 413.97698 | 413.97724 | +0.6 |
| $C_9F_{20}N^+$ | 3,542.06 | 501.97060 | 501.97112 | +1.0 |

Figure 5:
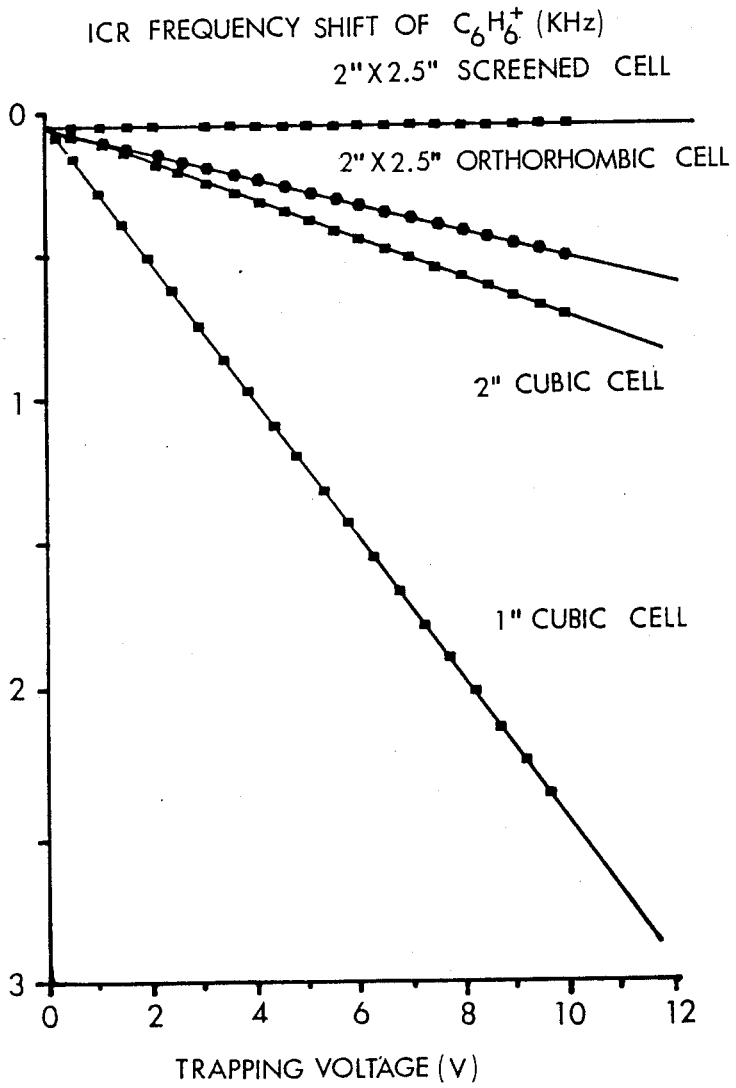
FIG. 5 is a plot of the experimental ICR frequency shift of $C_6H_6^+$ at 3.0 tesla against the trapping voltage in 1" cubic, 2" cubic, and 2.5"×2"×2" screened orthorhombic ion cells.

FIG. 5 is a plot of ICR frequency shift of $C_6H_6^+$ at 3.0 tesla as a function of trapping voltage. Each time domain signal was produced by a single frequency on-resonance excitation of 30 V (peak-to-peak) amplitude at 601.703 kHz for 250 μs (screened and unscreened 2"×2.5" orthorhombic cell) or 60 μs (1" cubic cell), and detected in heterodyne mode at a bandwidth of 62.992 kHz (16K time-domain data, to which another 16K of zeroes were added before discrete Fourier transform). Trapping dc potential was varied from 0.5–10 V.

Figure 6:
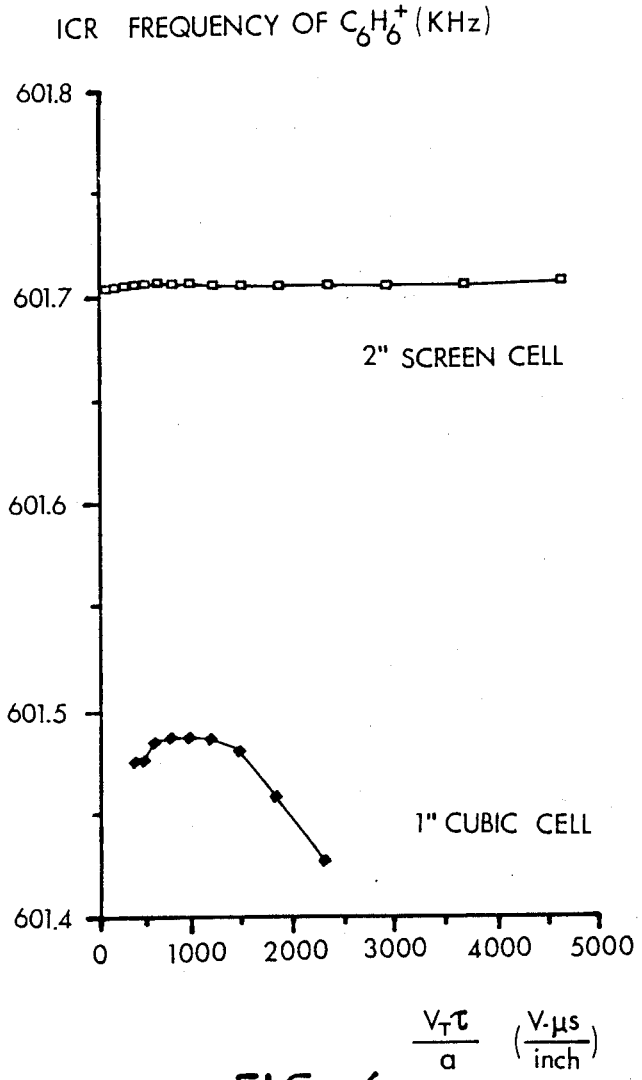
FIG. 6 is a plot of ICR frequency of $C_6H_6^+$ as a function of $V_T T/a$, in which $V_T$ is the trapping voltage, T is the excitation period (in microseconds), and a is the separation between the two excitation plates (in inches).

FIG. 6 is a plot for the 2 inch screen cell and the one inch cubic cell of ICR frequency of $C_6H_6^+$ as a function of $V_T T/a$, in which $V_T$ is the trapping voltage, T is the excitation period (μs), and a is the separation between the two excitation plates (inches). In each case, ICR orbital radius is directly proportional to $V_T T/a$, so that the graph may be viewed as a plot of ICR frequency versus ICR orbital radius. Each time-domain signal was again excited by single frequency on-resonance excitation for 310 μs (2" screen cell) or 97 μs (1" cubic cell) and detected in heterodyne mode at a bandwidth of 17.582 kHz (16K time-domain data, to which another 16 K zeroes were added before discrete Fourier transform). Trapping voltage was maintained at 1 V dc, and radiofrequency excitation magnitude adjusted from 0.2 V to 30 V (peak-to-peak) by variable attenuation.

An ultra-high resolution ($m/\Delta m=6.08\times10^6$) mass spectrum of $H_2O^+$ was obtained at a neutral pressure of $1.2\times10^{-8}$ torr, by means of single-frequency on-resonance excitation: 30 V (peak-to-peak) at 2.607 MHz for 260 μs, and detected in heterodyne mode at a bandwidth of 1.689 kHz (16K time-domain data, to which another 48K zeroes were added before discrete Fourier transform).

Figure 7A:
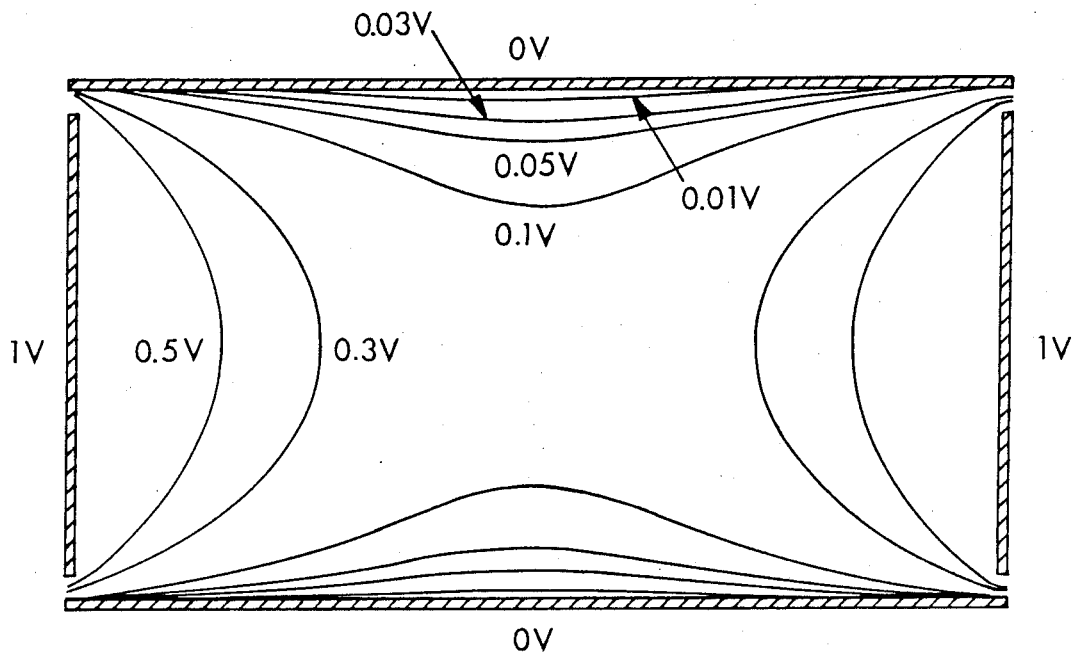
FIG. 7A is a representation of the two-dimensional contours of constant electrostatic potential for an orthorhombic cell.
Figure 7B:
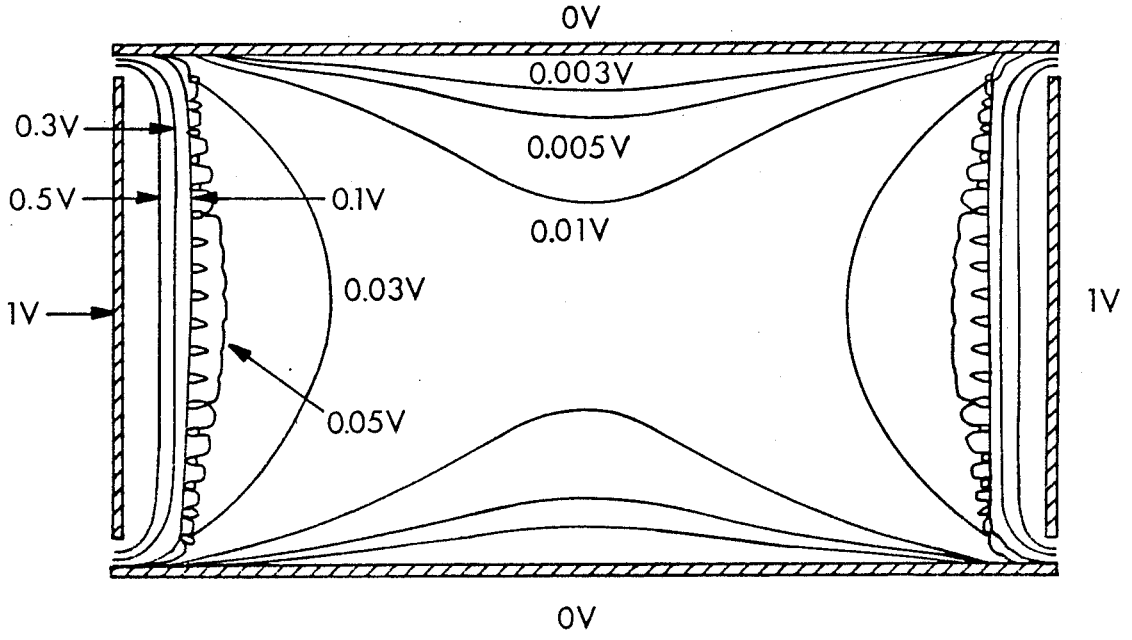
FIG. 7B is a representation of the two-dimensional contours of constant electrostatic potential for a screened orthorhombic cell of the same dimensions as that of FIG. 7A.
Figure 8A:
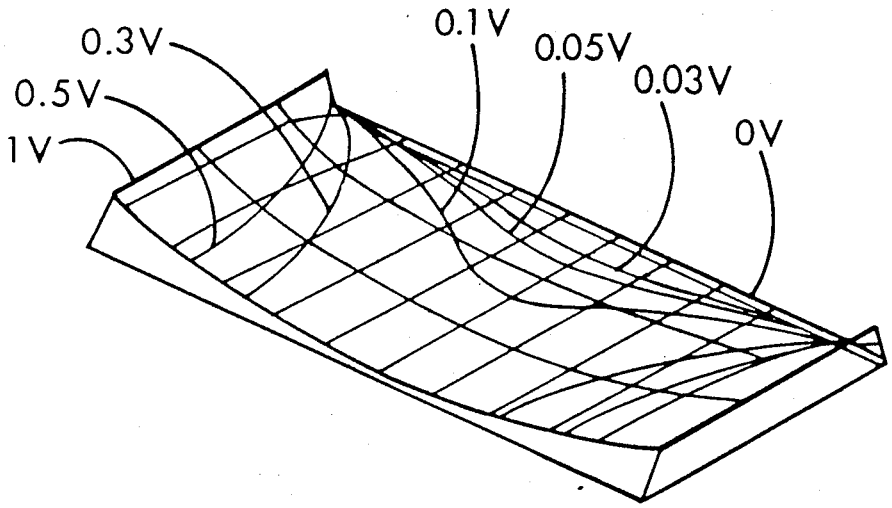
FIG. 8A is a three-dimensional representation of the contours of FIG. 6A.
Figure 8B:
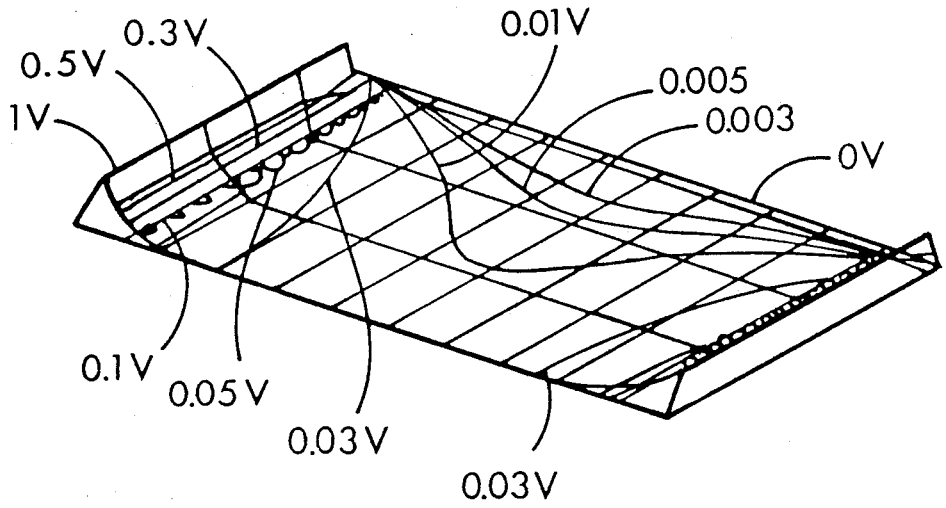
FIG. 8B is a three-dimensional representation of the contours of FIG. 6B.

A computer program, SIMION PC/PS2 Version 4.0 by Dahl, D. A. and Delmore, J. E., Idaho National Engineering Laboratory (EGG-CS-7233, Rev. 2, April, 1988), was used to compute the potential at specified grid points within the static electromagnetic ion cell (by the finite difference method) iteratively until a self-consistent array of grid point potentials was found. A major limitation of SIMION is that although it can determine the potential at each of the points of a three-dimensional spatial grid, the potential boundary conditions may be specified in only two perpendicular directions. Thus, SIMION is quantitatively accurate only for cylindrically symmetric electrode arrangements, or for geometries in which the electrodes separated along one axis are infinitely far apart. Nevertheless, SIMION is suitable for qualitative and/or semi-quantitative analysis. FIGS. 7A and 7B present SIMION contour maps of the two-dimensional x-z electrostatic potential of orthorhombic and screened ion cells, respectively, of the same dimensions. As noted above, the two y-electrodes are considered to be infinitely far apart in this computation. FIGS. 8A and 8B show the electrostatic potentials for the orthorhomibic and screen in cells, respectively, displayed in three-dimensions. The approximately quadratic variation of electrostatic potential with z-distance (at zero x-distance) for the conventional cell is most readily seen in FIG. 8A. Both FIGS. 7B and 8B show that the z-axis trapping potential drops rapidly to near-zero as one moves away from the screen toward the center of the cell. Beyond about 1 mesh diameter away from the screen, the electrostatic potential in the screened cell is about 15–20 times smaller than at the corresponding z-position in the unscreened orthorhombic cell.

The dependence of observed ICR frequency on trapping voltage may be approximated as follows:

$$\omega_0 = \frac{1}{2}\left(\omega_c + \sqrt{\omega_c^2 - \frac{8q\alpha V_T}{ma^2}}\right) \approx \omega_c - \frac{2q\alpha V_T}{ma^2} = \omega_c - \frac{2\alpha V_T}{a^2 B_0}$$

in which $V_T$ is the trapping voltage. From the derivative of the last of the above equations with respect to $V_T$, the variation of lCR frequency with trapping voltage, $V_T$, is obtained:

$$\frac{\partial \omega_0}{\partial V_T} = -\frac{2\alpha}{a^2 B_0} \text{ (rad} \cdot s^{-1}/\text{V)}$$

$$\frac{\partial \nu_0}{\partial V_T} = \frac{\alpha}{\pi a^2 B_0} \text{ (Hz/V)}$$

The above equations predict that the frequency shift, $\partial\nu_0/\partial V_T$, in a one-inch cubic cell is approximately 223 Hz/V, in excellent agreement with the experimental result of 231 Hz/V obtained from a plot of ICR frequency of $C_6H_6^+$ at 3.0 tesla versus trapping ICR frequency of $C_6H_6^+$ at 3.0 tesla versus trapping voltage shown in FIG. 5. Thus, the electrostatic potential in the cubic cell is quadrupolar to a good approximation. Similarly, the two-inch cross-section cubic cell gives a smaller but still substantial experimental lCR frequency shift of 64.6 Hz/V, again in reasonable agreement With the value of 56.8 Hz/V computed from the above equations at the slightly lower magnetic field strength (3.003 tesla) for those measurements. For the 2"×2"×2.5" orthorhombic cell under the same conditions as the two-inch cubic cell, the experimental ICR frequency shift is 41.4 Hz/V.

In contrast, the two-inch cross-section screened cell gives a frequency shift of only about 0.67 Hz/V, or about 60 times smaller than that for an unscreened cell of the same approximate dimensions. The screens therefore effectively reduce the static electric field in the cell by a large factor, except at z-positions within about 1 mesh diameter of either screen.

Since the main source of deviation of ICR frequency from the cyclotron frequency $\omega_c$ is the shift induced by the trapping potential, the screened cell can improve the accuracy of mass measurement in Fourier transform ICR mass spectrometry because the mass calibration equation will require smaller correction terms. For example, the mass calibration obtained with the two-inch cross-section orthorhombic screened cell is better by a factor of two or more than has been obtained for any cell size or shape, for the same cell dimensions, magnetic field strength, number of ions, and background pressure. In a cubic or cylindrical cell, the quadrupolar electric potential approximation is accurate only near the center of the cell. As a result, the detected ICR frequency varies with ICR orbital radius. Because the addition of grounded screens reduces the electric field magnitude everywhere in the cell except in the immediate vicinity of the screens, the radial component of electric field in particular is also reduced. Because the screens reduce the average electric field magnitude by a factor of about 15–20 (see FIGS. 7A and 7B), the variation of ICR frequency with ICR orbital radius is also reduced by a factor of approximately 10–20 (see FIG. 5). In fact, the variation of ICR frequency with ICR orbital radius is smaller for the screened orthorhombic cell than for a "hyperbolic" cell of similar dimensions, presumably because the finite extent of the electrodes of the hyperbolic cell distorts its potential from a purely quadrupolar shape.

The screened trap performance shown in FIG. 6 is important for two reasons. First, mass accuracy such as shown in Table I should now be more reproducible, since a variation of ion orbital radius arising from, e.g., variation in ICR excitation conditions, from one experiment to another should have much less effect on measured ICR frequencies. Second, FT/ICR mass resolution during the detection period has been much higher than mass resolution during the excitation period, because ICR detection is conducted at a fixed ICR orbital radius, whereas ICR orbital radius must necessarily increase during excitation. Thus, any variation in ICR frequency with ICR orbital radius must reduce the maximal mass resolution during excitation. Stored waveform inverse Fourier transform excitation offers optimal mass selectivity for single- or multiple-ion excitation experiments, but is ultimately resolution-limited by any ICR frequency shift during excitation. With the screened cell, FT/ICR mass resolution during excitation may potentially approach the high mass resolution already demonstrated during ICR detection.

A reduction in the static electric field in the cell 20 also has a potential for a much higher upper mass limit, which would allow for mass analysis of large molecules, such as biological molecules. For an ion ensemble described by a Boltzmann distribution, the upper mass limit above which a fraction, K, of ions has ICR orbital radius larger than the cell dimensions is given by $$m_{upper} = \frac{q^2 B_0^2 a^2}{8[4kT(-\ln K) + \alpha q V_T]}$$

The first term in the denominator of the above equation is generally negligible. For example, if the highest singly-charged ion mass for which 95% of room-temperature (T=300° K.) ions are ejected before the excitation event is sought, about, the first term of the denominator of the above equation contributes only about 0.0053 eV. Thus, to a good approximation, the upper mass limit becomes $$m_{upper} \approx \frac{q B_0^2 a^2}{8\alpha V_T}$$

Therefore, since the screened cell reduces the effective trapping voltage by more than an order of magnitude, it is reasonable to expect the upper mass limit for a screened cell to increase by a substantial factor compared to an unscreened cell of the same dimensions In the limit that the time-domain acquisition period is much longer than the damping constant, $\tau$, for exponential decay of the lCR time-domain signal, FT/lCR mass resolution, $m/\Delta m$, increases linearly with $\tau$:

$$\frac{m}{\Delta m} = 1.81\ \nu_0\ \tau$$

in which $\Delta m$ is defined as the full magnitude-mode peak width at half-maximum peak height and $\tau_o = \omega_o/2\pi$ is the cyclotron frequency in hertz. In a screened cell, it is possible for ions to collide with screen electrodes and to be lost from the cell. Since any loss of ions accelerates time-domain signal decay, such ion loss could, in principle, degrade mass resolution. However, the screened orthorhombic cell has produced FT/ICR mass spectrum of $H_2)^+$ with mass resolution as high as $6.08\times10^6$ in the heterodyne mode at a bandwidth of 1.689 kHz, acquisition time 4.857 s, and sample pressure $1.2\times10^{-8}$ Torr. Therefore, ion losses due to ion-screen collisions do not appear to be significant.

Figure 9:
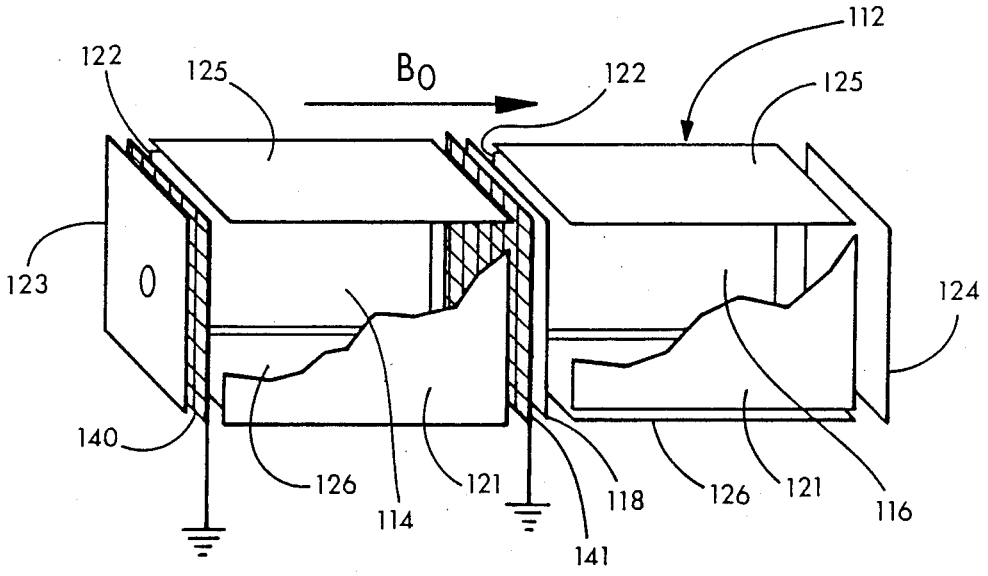

FIG. 9 shows an experimental arrangement of a cell 120 designed to provide a direct comparison of signal-to-noise ratio between screened and unscreened cells of identical dimensions (2"×2"×2.5") under identical conditions. The cell 112 depicted in FIG. 9 is a dual-cell arrangement, the cell having first and second sections, 114 and 116, that have a central trap electrode 118 positioned between them. The cell 112 is maintained in a substantially constant and preferably uniform magnetic field being indicated by the arrow $B_o$ in FIG. 9. The cell has opposed side plates 121 and 122 in each section serving as excitation electrodes, end trapping plates 123 and 124, and top and bottom plates 125 and 126, respectively, which may serve as detector electrodes. As shown in FIG. 9, screens 140 and 141 were initially positioned within the first section 114. Ions were introduced into this two-compartment cell 112 with the central trap electrode 118 grounded. After ions had partitioned equally between the two sections 114 and 116, the central trap electrode potential was increased to the same value as that for the two end trap plates 123 and 124, and excitation/detection was performed separately for ions in the two sections. The relative positions of the screened and unscreened sections were then interchanged, and the results of the two experiments averaged to correct for systematic differences between the two cell locations. In this way, the FT/ICR signal-to-noise ratio for $C_6H_6^+$ ions in the screened orthorhombic cell was found to be reduced only slightly (by 28%) compared to the signal-to-noise ratio for the equivalent unscreened cell. Thus, although some ions may be lost on or through the screens, the loss is not substantial, and is more than compensated by the other operational advantages of the screened cell.

In order to minimize hardware and software modifications to our instrument, both screen electrodes were connected to each other and permanently grounded. More generally, the static potential applied to each screen could be controlled independently. As a result, the "quench" event, in which one trap plate is set to +10 V and the other to −10 V, could, in principle, be less effective for z-ejection of ions because the screens largely shield the ions from the "quench" voltage pulse. However, experimental FT/ICR mass spectra obtained at a quench period up to 10–100 ms were virtually the same as for a (default) quench period of 200 μs. Therefore, the quench process appears successful even in the presence of the grounded screens. If quenching were insufficient, one could gate the voltage to the screens, so that the quench pulse is applied to the screen electrodes rather than to the trap electrodes.

As noted above, it is to be understood that the screens that may be used in conjunction with the present invention are not limited to those disclosed herein. It is to be further understood that the present invention is usable in cells of many different geometries, as well as cells of two or more compartments, and the geometries of the cell may mandate screens of different shapes and sizes. The present invention is also usable in cells having electrode plates in other than a planar shape. It is to be generally understood that the invention is not confined to the particular embodiments set forth herein as illustrative, but embraces all such modified forms thereof as come within the scope of the following claims.

What is claimed is:

1. Mass spectrometry apparatus comprising:

(a) an ion cell into which an ion sample may be introduced, the cell including a plurality of electrode plates that define the cell boundary, the electrode plates including trapping plates that produce a trapping potential by the application of a static voltage to the trapping plates, the trapping potential constraining movement of ions in the direction of a magnetic field to be applied to the cell;

(b) an ion generating source that produces ions in the cell;

(c) magnetic field means for creating a unidirectional magnetic field, the magnetic field means mounted so that the unidirectional magnetic field passes through the cell in a predetermined location;

(d) at least one screen positioned within the cell proximate each of the trapping plates, the screen having a plurality of interstitial openings, and means for maintaining the screen at a selected potential to substantially shield the interior of the cell from the potential applied to the trapping plate; and (e) means for detecting motion of ions in the cell and providing an output signal indicative thereof.

2. The mass spectrometry apparatus of claim 1 wherein the interstitial openings form a two-dimensional lattice.

3. The mass spectrometry apparatus of claim 1 wherein the screen is a mesh of interwoven wire strands.

4. The mass spectrometry apparatus of claim 1 wherein the screen is a planar array of parallel wire strands.

5. The mass spectrometry apparatus of claim 1 wherein the screen is attached to a frame to fixedly hold the screen in place.

6. The mass spectrometry apparatus of claim 1 wherein the screen is made of a non-magnetic or slightly magnetic conductive material.

7. The mass spectrometry apparatus of claim 6 wherein the frame is made of a non-magnetic or slightly magneti conductive material.

8. The mass spectrometry apparatus of claim 1 wherein the means for maintaining the screens at a selected potential is an electrical connection between the screens and a ground.

9. The mass spectrometry apparatus of claim 1 wherein the means for maintaining the screen at a selected potential is a electrical connection between the screens and a voltage supply.

10. The mass spectrometry apparatus of claim 1 wherein the interstitial openings are large enough to allow passage of ions therethrough.

11. The mass spectrometry apparatus of claim 1 wherein the interstitial openings are small enough to substantially shield the cell from the static electric field.

12. The mass spectrometry apparatus of claim 1 wherein the cell has a first section and a second section separated by a trapping plate, and there are two screens, each of the screens positioned proximate to the trapping plates in one of the sections.

13. An ion cell for use in a mass spectrometer, the cell comprising:

(a) a plurality of electrode plates that define the cell boundary, the electrode plates including two trapping plates that produce a trapping potential by the application of a static voltage to the trapping plates, the trapping potential constraining movement of ions in the direction of a magnetic field to be applied to the cell; and (b) screens positioned within the cell proximate each of the trapping plates, the screens having a plurality of interstitial openings, and means for maintaining the screens at a selected potential to substantially shield the interior of the cell from the potential applied to the trapping plates.

14. The ion cell of claim 13 wherein the interstitial openings form a two-dimensional lattice.

15. The ion cell of claim 13 wherein one of the screens is a mesh of interwoven wire strands.

16. The ion cell of claim 13 wherein one of the screens is a planar array of parallel wire strands.

17. The ion cell of claim 13 wherein one of the screens is attached to a frame to fixedly hold the screen in place.

18. The ion cell of claim 13 wherein one of the screens is made of a non-magnetic or slightly magnetic conductive material.

19. The ion cell of claim 17 wherein the frame is made of a non-magnetic or slightly magnetic conductive material.

20. The ion cell of claim 13 wherein the means for maintaining the screens at a selected potential is an electrical connection between the screens and a ground.

21. The ion cell of claim 13 wherein the means for maintaining the screens at a selected potential is an electrical connection between the screens and a voltage supply.

22. The ion cell of claim 13 wherein the interstitial openings are large enough to allow passage of ions therethrough.

23. The ion cell of claim 13 wherein the interstitial openings are small enough to substantially shield the cell from the static electric field.

24. The ion cell of claim 13 wherein the cell has a first section and a second section separated by a trapping plate, and there are two screens, each of the screens positioned proximate to the trapping plates in one of the sections.

25. A method of mass spectrometry comprising the step of:

(a) introducing a sample into a cell, the cell boundary being defined by a plurality of electrode plates, the electrode plates including a trapping plate;

(b) providing a unidirectional magnetic field that passes through the cell in a predetermined location;

(c) producing ions in the cell;

(d) producing a trapping potential proximate the trapping plate to constrain movement of ions in the direction of the magnetic field by the application of static voltage to the plate;

(e) placing a screen having a plurality of interstitial openings within the cell proximate one of the trapping plates and controlling the potential applied to the screen to reduce the electric field within the cell;

(f) detecting motion of ions in the cell and providing an output signal indicative thereof.

26. The method of claim 25 wherein the interstitial openings form a lattice.

27. The method of claim 25 wherein one of the screens is a mesh of interwoven wire strands.

28. The method of claim 26 wherein one of the screens is a planar array of parallel wire strands.

29. The method of claim 25 wherein the screen is attached to a frame to fixedly hold the screen in place.

30. The method of claim 25 wherein one of the screens is made of a non-magnetic or slightly magnetic conductive material.

31. The method of claim 29 wherein the frame is made of a non-magnetic or slightly magnetic conductive material.

32. The method of claim 25 wherein the screen is grounded.

33. The method of claim 25 wherein the screen is maintained at a selected potential.

34. The method of claim 25 wherein the interstitial openings are large enough to allow passage of ions therethrough.

35. The method of claim 25 wherein the interstitial openings are small enough to substantially shield the cell from the static electric field.

36. The method of claim 25 wherein the cell has a first section and a second section separated by a trapping plate, and there are two screens, each of the screens positioned proximate to the trapping plates in one of the sections.

37. A method of mass spectrometry comprising the steps of:

(a) introducing a sample into a cell, the cell boundary being defined by a plurality of electrode plates, the electrode plates including a trapping plate;

(b) providing a unidirectional magnetic field that passes through the cell in a predetermined location;

(c) producing ions in the cell;

(d) producing a trapping potential proximate the trapping plate to constrain movement of ions in the direction of the magnetic field by the application of static voltage to the plate;

(e) shielding the cell from a static electric field resulting from the application of the static voltage to the trapping plate; and (f) detecting motion of ions in the cell and providing an output signal indicative thereof.

* * * * *